US006601377B2

(12) United States Patent
Tsukamoto

(10) Patent No.: US 6,601,377 B2
(45) Date of Patent: Aug. 5, 2003

(54) GLAND PACKING MATERIALS MADE FROM EXPANSIVE GRAPHITE, GLAND PACKING MADE FROM EXPANSIVE GRAPHITE MADE FROM THE MATERIALS, AND A PRODUCING METHOD OF GLAND PACKING MADE FROM EXPANSIVE GRAPHITE

(75) Inventor: Katsuro Tsukamoto, Takarazuka (JP)

(73) Assignee: Japan Matex Kabushiki Kaisha, Osaka (JP)

( * ) Notice: Subject to any disclaimer, the term of this patent is extended or adjusted under 35 U.S.C. 154(b) by 44 days.

(21) Appl. No.: 09/918,650

(22) Filed: Jul. 30, 2001

(65) Prior Publication Data

US 2002/0069635 A1 Jun. 13, 2002

(30) Foreign Application Priority Data

Oct. 19, 2000 (JP) ..... 2000-319426

(51) Int. Cl.[7] ..... D02G 3/02; D02G 3/36
(52) U.S. Cl. ..... 57/200; 277/650; 57/200
(58) Field of Search ..... 57/200, 210, 204, 57/212; 428/59, 364, 365; 277/650

(56) References Cited

U.S. PATENT DOCUMENTS 4,705,722 A * 11/1987 Ueda et al. ..... 428/365
4,961,988 A * 10/1990 Zhu ..... 442/267
5,134,030 A * 7/1992 Ueda et al. ..... 428/365
5,240,769 A * 8/1993 Ueda et al. ..... 428/365
5,549,306 A * 8/1996 Ueda ..... 277/537
5,605,341 A * 2/1997 Ueda ..... 277/536
5,683,778 A * 11/1997 Crosier ..... 428/59
5,765,838 A * 6/1998 Ueda et al. ..... 277/650
6,270,083 B1 * 8/2001 Hirschvogel et al. ..... 277/536
6,299,976 B1 * 10/2001 Tsukamoto ..... 428/364
6,358,956 B1 * 3/2002 Hartman et al. ..... 514/252.13
6,502,382 B1 * 1/2003 Fujiwara et al. ..... 57/200
2003/0042691 A1 * 3/2003 Tsukamoto et al. ..... 277/633

FOREIGN PATENT DOCUMENTS

JP 11336911 A * 12/1999 ..... F16J/15/22

* cited by examiner

*Primary Examiner*—John J. Calvert
*Assistant Examiner*—Shaun Hurley
(74) *Attorney, Agent, or Firm*—Curtis L. Harrington

(57) ABSTRACT

The present invention relates to gland packing materials made from expansive graphite, gland packing made from expansive graphite made from the materials, and a producing method of gland packing made from expansive graphite; braiding thread is a filamentose with winding or twisting a strip laminated sheet that a bundle of sprit fiber is laminated and unified through an adhesive layer so as to be a reinforcing material, and a cord body is constructed by braiding the braiding thread, then a packing is constructed by pressure forming this cord body.

4 Claims, 11 Drawing Sheets

GLAND PACKING MATERIALS MADE FROM EXPANSIVE GRAPHITE, GLAND PACKING MADE FROM EXPANSIVE GRAPHITE MADE FROM THE MATERIALS, AND A PRODUCING METHOD OF GLAND PACKING MADE FROM EXPANSIVE GRAPHITE

BACKGROUND OF THE INVENTION

1. Field of the Invention

The present invention relates to materials used in gland packing made from expansive graphite, the gland packing made from expansive graphite made from the materials and a producing method of gland packing made from expansive graphite, and more particularly, it relates to the materials gland packing materials with producing facility in addition to sealing ability, heat resistance, chemical resistance and such properties and without causing stress relaxation made from expansive graphite, the gland packing made from expansive graphite made from the materials and producing method of gland packing made from expansive graphite.

In the specification, the term "twisting a strip laminated sheet" means a movement of constructing a strip laminated sheet into a cylindrical with two parts of a strip laminated sheet that separates into axially rotate on opposite direction each other. In such case, both of twisting cylindrical so that adherence covers a linear member core, and twisting cylindrical (circular cylinder substantially without having hollow part is preferable) so that does not cover a linear member core are available.

In the specification, "winding a strip laminated sheet" means a movement of constructing a strip laminated sheet into a cylindrical with a strip laminated sheet winding spirally around axis. In such case, both of twisting cylindrical so that adherence covers a linear member core, and twisting cylindrical (circular cylinder substantially without having hollow part is preferable) so that does not cover a linear member core are available.

In the specification, means the product of a tensile strength of the materials (kgf/cm$^2$) and the cross sectional area of the materials (cm$^2$) in case of materials resulting in a fracture.

2. Description of the Related Art

As a packing that carries out a shaft sealing of fluid apparatus, there has been a gland packing made from expansive graphite hitherto. The gland packing made from expansive graphite is packed in a room that is formed in-between a shaft and an apparatus causing, i.e., the inside of stuffing box, in order to prevent fluid from in-between the shaft and the apparatus causing. Compared with a packing material such as asbestos, the expansive graphite surpasses in hardly causing stress relaxation, lubricating ability, heat resistance, chemical resistance and such properties, but on the other hand, it has defects that its tensile strength is weak and also fragile. Thus, when constructing a sheet from expansive graphite and twist processing such sheet, there have been circumstances wherein said sheet fractures due to a big tensile force reacted thereto. From such reasons, there have been few circumstances wherein a gland packing made from expansive graphite is constructed from expansive graphite itself, and it is usually produced by reinforcing with other materials.

As a gland packing made from expansive graphite that has a reinforced structure, the following has been suggested.

For example, a gland packing made from expansive graphite wherein: a laminated sheet is constructed by laminating a cotton threaded fabric sheet on one surface of expansive graphite sheet; a strip laminated sheet is formed by cutting such laminated sheet; braiding yarn is constructed by a twist processing of such laminated sheet so that the strip laminated sheet covers a reinforcing linear member and that the expansive graphite sheet positions on the outside, and after this, such braiding yarn is braided into a gland packing made from expansive graphite sheet, is suggested.

In this example, when twist processing the laminated sheet and braiding the braiding yarn, tensile force reacts to the expansive graphite sheet. However, the expansive graphite does not fracture, because it is reinforced with the cotton threaded fabric sheet.

However, in the prior art as mentioned above, there had been some problems that follow.

That is, the tensile force of cotton linear member is not very high, in order to the cotton threaded fabric sheet to function sufficiently as a reinforcing material, it was necessary to have the sectional area of said sheet bigger. To correspond to this necessary, the width of cotton threaded fabric sheet was widened by winding the width of strip laminated sheet, in particularly, the width had been set larger than 10 mm. However, it was difficult to gain braiding yarn of good quality. This was because the flexibility of the laminated sheet gets lower as the width of thereof becomes over 10mm, causing a difficulty in a twist processing. Also, the braiding yarn gained in such way was inferior in flexibility, causing a difficulty when braiding thereof.

Further, heat loss of the cotton-threaded fabric under heat circumstance is big. Thus, the stress relaxation under heat circumstance is big, and it was difficult to save the capability of gland packing itself unless practicing tightening when the cotton threaded fabric is used as a gland packing material.

Further, the gland packing made from expansive graphite that was gained by braiding with this braiding yarn is also inferior in flexibility. If such gland packing made from expansive graphite with low flexibility was packed in the stuffing box, it might not be possible to secure sufficient sealing ability, even if the gland was bound tightly.

BRIEF SUMMARY OF THE INVENTION

The present invention has invented under such actual circumstances, and aims to offer the gland packing materials made from expansive graphite, the gland packing made from expansive graphite and a producing method of gland packing made from expansive graphite, with producing facility in addition to sealing ability, heat resistance, chemical resistant and such properties and with causing no stress relaxation.

The present invention as set forth in claim 1 is a braiding yarn used in a gland packing made from expansive graphite that is gained by a pressure forming of a cord body constructed by braiding with the braiding yarn wherein: a bundle of opened carbon multifilament is laminated and unified through an adhesive layer on a surface of expansive graphite sheet; this adhesive layer is used as a reinforcing material of the strip laminated sheet consisting of the bundle of opened carbon multifilament, adhesive layer, and the expansive graphite sheet; the strip laminated sheet is winded and twisted to be filamentous as the bundle of opened carbon multifilament is positioned outside of the braiding yarn.

The present invention as set forth in claim 2 is a braiding yarn set forth in claim 1 wherein: said strip laminated sheet is winded or twisted to be filamentous so that said laminated sheet covers a reinforcing linear member.

The present invention as set forth in claim 3 is a braiding yarn set forth in claim 1 wherein: said filamentous body is constructed, and another filamentous body is constructed from a strip foil made from aluminum, aluminum alloy, nickel, nickel alloy, copper, or copper alloy so that the filamentous body covers whole said filamentous body continuously or intermittently.

The present invention as set forth in claim 4 is a braiding yarn set forth in claim 2, wherein said reinforcing linear member constructed from at least one material from aramid resin, polytetrafluoroethylene resin, nylon resin, acrylic resin, hydroxybenzene resin or carbide resin off these, glass, metal, asbestos or a variety of ceramic.

By offering these inventions, the subjects as mentioned above are solved.

DESCRIPTION OF PREFERRED EMBODIMENTS OF THE INVENTION

The gland packing made from expansive graphite set forth the present invention and the materials used in this packing will be explained with a reference to the drawings.

Figure 1:
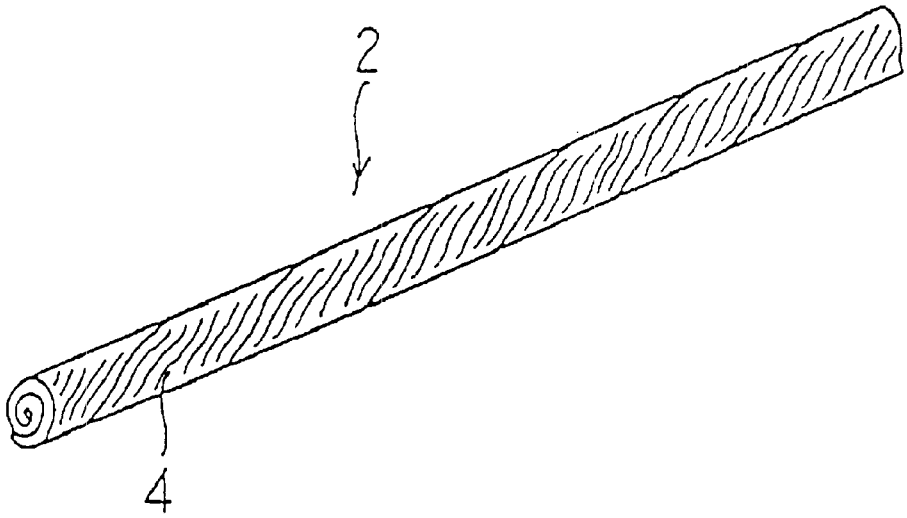
FIG. 1 is a perspective view showing a first example of braiding yarn of the first embodiment set forth the present invention.
Figure 2:
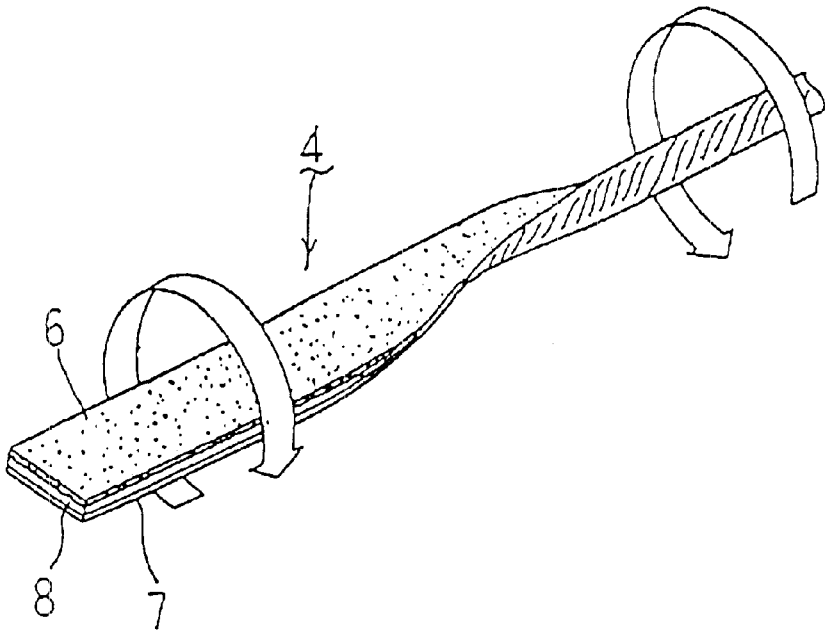
FIG. 2 is a view showing a producing process of the braiding yarn shown in FIG. 1.
Figure 3:
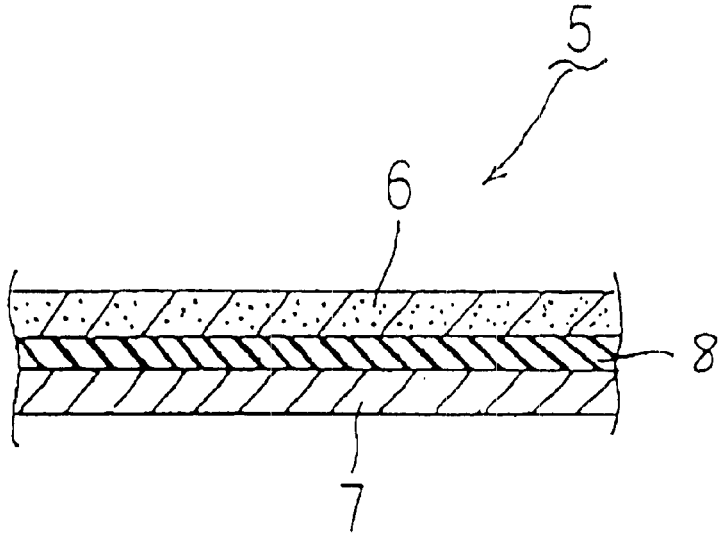
FIG. 3 is a sectional view showing a laminated sheet that is used to produce braiding yarn shown FIG. 1.
Figure 4:
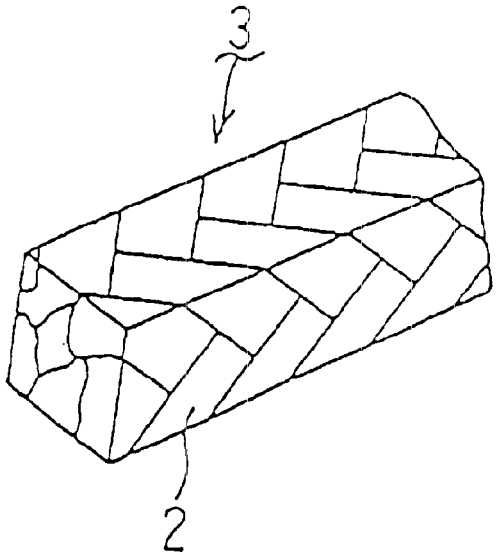
FIG. 4 is a perspective view of cord body comprising of the braiding yarn of shown FIG. 1.
Figure 5:
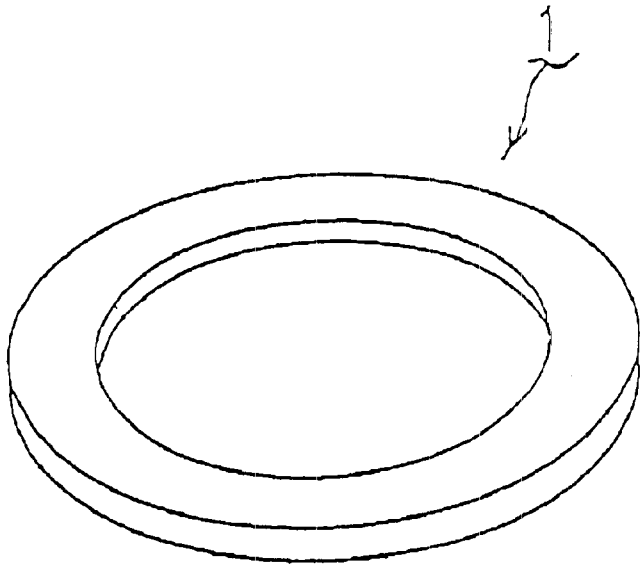
FIG. 5 is a perspective view showing gland packing made from expansive graphite comprising of from the braiding yarn shown in FIG. 1.

FIG. 1 is a perspective view showing a first example of braiding yarn of the first embodiment set forth from the present invention. FIG. 2 is a view showing a producing process of the braiding yarn shown in FIG. 1. FIG. 3 is a sectional view showing a laminated sheet that is used to construct the braiding yarn shown FIG. 1. FIG. 4 is a perspective view of a cord body comprising of the braiding yarn of shown FIG. 1. FIG. 5 is a perspective view showing a gland packing made from expansive graphite comprising of the cord body shown in FIG. 4.

The gland packing (1) made from expansive graphite set forth from the present invention (referred to as a packing hereinafter) can be gained by pressure forming a cord body (3) that is constructed by braiding with braiding yarn (2).

These structural elements will be explained in detail gradually hereinafter.

The braiding yarn (2) is constructed by rolling a strip laminated sheet (4) and made it filamentous or by twisting a strip laminated sheet (4) and made it filamentous. FIG. 2 shows the appearance of the laminated sheet (4) when it is twisted. The strip laminated sheet (4) is structured by cutting the laminated sheet (5) shown in FIG. 3 into strips. The laminated sheet (5) is structured by the expansive graphite sheet (6) that is laminated and unified with the bundle of strip opened carbon multifilament (referred as a bundle of opened carbon multifilament hereinafter) (7) through adhesive layer (8). The adhesive layer (8) has both the role of reinforcing material as well as the role of adhesive itself.

The kind of layer of adhesive (8) is not particularly restricted and it can be structured by organic adhesive, inorganic adhesive and mixture of organic and inorganic adhesive and such, and in form it can be formed liquid, emulsion, film, non woven fabric and such. Besides, the way of usage is also not particularly restricted, it can be selected application, thermocompression bonding, spray and such.

It is desirable to use water soluble thermal plasticity adhesive, and it is more desirable to use non-polluting polyvinyl alcohol for the adhesive layer (8). It is possible to use the polyvinyl alcohol by applying the surface of expansive of graphite sheet (6) or the bundle of opened carbon multifilament (7) by keeping the polyvinyl alcohol liquid and also it is possible to use by blasting. In case of setting the polyvinyl alcohol by blasting, for example, it is possible to set to the nonwoven fabric.

In case of setting a nonwoven fabric to the polyvunylalcohol (referred to as a PVA hereinafter), the adhesive layer (8) is laminated by the condition of PVA resin fibers stretching irregular direction, and these PVA resin fibers change to a sheet by fixing each other. The adhesive layer (8) with such structure has great tensile strength against tensile force in any directions, and especially in a condition where the layer is processed to be made into strips, it shows great tensile strength against tensile force in an axial direction.

Additionally, in case of gluing an expansive graphite sheet (6) and a bundle of opened carbon multifilament (7), it can be laminated and unified strengthen by stressing both side of the expansive graphite sheet (6) and the bundle of opened carbon multifilament (7) by laminating adhesive layer (8) such as PVA layer between the expansive graphite sheet (6) and the bundle of opened carbon multifilament (7).

As the expansive graphite sheet (6), after making a interlayer compound by reacting graphite powder, such as natural graphite and kish graphite, with concentrated sulfuric acid, concentrated nitric acid and such, the residue of the compound is gained by a water bathing and is expanded by a quick heating, so that expansive graphite can be gained and that expansive flexible graphite is molded with compression with a rolling material and such to be in a sheet-shape for a usage.

The concentration of expansive graphite sheet (6) is not particularly restricted, but it is preferred to be 0.80–2.2 g/cm$^3$. When the concentration is in this range, unevenness in crystal level is formed on the surface of expansive graphite sheet (6), causing an anchor effect to the laminated material thereon. Comparatively speaking, when the concentration is below 0.80·/cm·, texture of organization becomes too rough, leading a lowering of sealing ability of a packing being made. On the other hand, when the concentration is over 2.2·/cm·, there is a possibility that the texture of organization becomes too fine to cause an anchor effects, and not to satisfactorily laminate with a bundle of opened carbon multifilament (7).

Furthermore, the thickness of the expansive graphite sheet (6) is not particularly restricted, but it is preferred to be about 0.10–1.5 mm. When the thickness is below 0.10 mm, the outstanding heat resistance, corrosion resistance, and abrasion resistance of the expansive graphite cannot be manifested. Also, such a thin expansive graphite sheet (6) is uneconomical because of difficultness of manufacture. Although, when the thickness of expansive graphite sheet (6) exceeds the 1.5 mm, the brittleness of expansive graphite appears.

The bundle of opened carbon multifilament (7) has roles both reinforcing expansive graphite sheet (6) and as solid lubricant material. The bundle of opened carbon multifilament (7) is laminated on a surface of expansive graphite sheet (6) by through adhesive layer (8). It can be adopted the laminating method that is mentioned above, however, in case of using heat anastomosis film as adhesive, it can be used for example PVA non woven fabric, PVA film, polyethylene film, olefin film and urethane film The bundle of opened carbon multifilament (7) surpasses in mechanical strength, and hardly changes its property such as mechanical strength between ·200·~600·600·, so it's also surpasses a low temperature characteristic and a high temperature characteristics. Therefore, the bundle of opened carbon multifilament (7) can be surely reinforced expansive graphite sheet (6) under the circumstance of a severity temperature as well as ordinary temperature. Additionally, the bundle of opened carbon multifilament (7) has outstanding lubricating and sealing ability; it can be gained the packing (1) that has outstanding lubricating and sealing ability by constructing braiding yarn as the bundle of opened carbon multifilament (7) is positioned outside the packing (1). Further more, since the bundle of opened carbon multifilament (7) surpasses in corrosion resistance and abrasion resistance, it can be proof against long-term usage even under a harsh environment, such as a chemical plant.

It is desirable that the thickness of the bundle of opening fiber (7) is between 0.05~0.5 mm, and it is more desirable between 0.15~0.2 mm. The reason is that when the thickness is below 0.05 mm, it is impossible to get enough lubricating and sealing ability, on the contrary, when the thickness is over 0.5 mm, it is impossible to get enough flexibility.

The manufacturing method of the bundle of opened carbon multifilament (7) is not particularly restricted, it can be adopted the public known various manufacturing method; it is desirable to use the manufacturing method recorded in U.S. Pat. No. 3,049,225 or U.S. Pat. No. 3,064,019. In case of using these manufacturing method that is recorded in official gazette of manufacturing the bundle of opened carbon multifilament (7), the carbon fiber multifilament is sent from yarn supply part to tread taking up part while be doing feed control to cause constant overfeed situation, and ventilate the air current to the above-mentioned multifilament against cross direction, and make this multifilament give bow shape to the leeward direction, and make this multifilament construct sheet type of bundle of opened carbon multifilament by separating the filament that composes this multifilament. By this manufacturing method, it is possible to get high quality sheet-type bundle of opened carbon multifilament that the each fiber is stretched straight without cutting, ranging regularity and parallel, fixed density, and no fuzz.

The strip laminated sheet (4) is constructed by cutting laminated sheet (5) to strip, some manufacturing methods cause the bundle of opened carbon multifilament that does not stretch straight and bent like wave, at the time of constructing laminated sheet (5). In this case, many fibers are cut when the laminated sheet (5) is cut into strip, but each fiber of the bundle of opened carbon multifilament is arranged very thick and uniformly, and it works big frictional force between each fiber. Therefore, each fiber is linked strongly to the direction of axial and axial right angle, and it will be a strip laminated sheet (4) that has strong tensile force.

Figure 6:
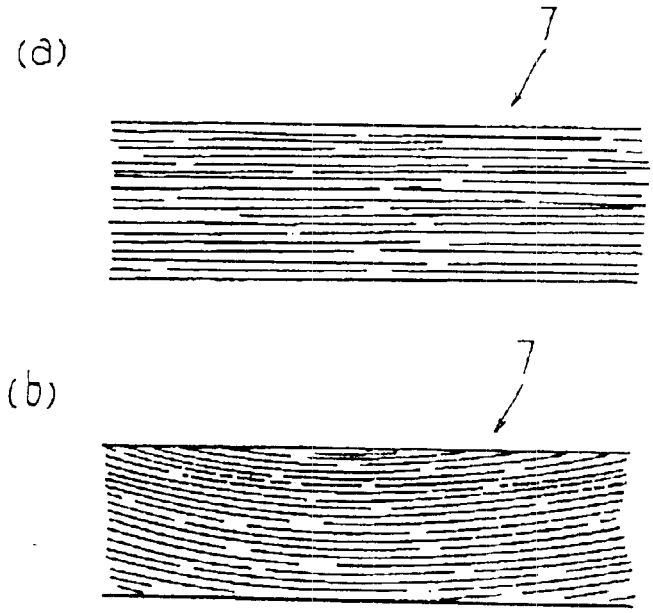
FIG. 6 is a view showing a bundle of opened carbon multifilament after cutting; (a) is a view of an example showing the cutting to given breadth of a bundle of opened carbon multifilament that each fiber stretches straight; (b) is a view of an example showing the cutting to given width of a bundle of opened carbon multifilament that each fiber winds wavy.

Usually, the bundle of opened carbon multifilament (7) is thick gathered of several kinds of fibers that are fallen into same direction, in other words, discontinuity fibers are laid thick continuously to the direction of axial and axial right angle. As mentioned above, in this aggregate of fiber, each fiber is linked big frictional force each other, and even if it is cut tilt, it is possible to make a piece of strong sprit sheet. In present invention, this outstanding characteristic of the bundle of opened carbon multifilament (7) is utilized effectively. In FIG. 6(*a*), an example of bundle of opened carbon multifilament (7) that each fiber stretches straight is constructed by cutting to breadth, is exhibited, and in FIG. 6(*b*), an example of bundle of opened carbon multifilament (7) that each fiber stretches wavy is constructed by cutting to breadth, is exhibited.

The laminated sheet (5) is constructed by laminating the bundle of opened carbon multifilament (7) by through expansive graphite sheet (6) to adhesive layer (8). The strip laminated sheet (4) is a thing that is cut this laminated sheet (5) into sprit. The breadth of strip laminated sheet (4) is 5~30 mm, it is preferable to be a 5~25 mm. In case of the breadth is more than 30 mm, the flexibility of a strip laminated sheet (4) goes down and difficult to work into braiding yarn (2). On the contrary, in case of the breadth is less than 5·, the tolerance tensile force goes down extremely, and there is a risk of fracture when a strip laminated sheet (4) work into braiding yarn (2). In case of the breadth is between 5~30 mm, a strip laminated sheet (4) has enough tolerance tensile force, so there is no risk in twisting and winding processing.

Since the strip laminated sheet (4) is reinforced by the bundle of opened carbon multifilament (7) and adhesive layer (8), it is possible to compose relatively thin. Therefore, it is possible to secure enough flexibility not only the strip laminated sheet (4) that the breadth is 5~10 mm but also the strip laminated sheet (4) that the breadth is over 10 mm. In case of composing braiding yarn (2) by using a strip laminated sheet (4) that its breadth is 5~10 mm, it is possible to construct a cord body (3) of big number braiding method such as twenty four and thirty two braiding method. Additionally, it is possible to compose a cord body (3) that is composed by big number braiding method by using several thicknesses braiding yarn (2). By this thing, it is possible to get high seal ability packing (1), because it enables the inside of a cord body (3) thicken.

The braiding yarn is a thing by twisting and making into yarn or winding and making into yarn. In winding processing and twisting processing, both processing methods the bundle of opened carbon multifilament (7) is positioned outside or the expansive graphite sheet (6) is positioned outside are good, but it is desirable that the bundle of opened carbon multifilament (7) is positioned outside. The reason is that in lubricating ability and sealing ability, the bundle of opened carbon multifilament (7) is better than expansive graphite sheet (6). Additionally, since the expansive graphite includes sulfur content, so there is a possibility of corrosion of stuffing box when the expansive graphite touches to metal especially metal stuffing box, but the bundle of opened carbon multifilament (7) doesn't include sulfur content, so the corrosion doesn't occur when the bundle of opened carbon multifilament (7) is positioned outside.

The winding and twisting method of the sprit laminated sheet (4) in present investment is not particularly restricted, however in case of winding method, for example, it is possible to choose the method that (4) winds tight spirally a strip laminated sheet (referred to FIG. 10), or the method that still twists this spiral sprit laminated sheet. In case of twisting, it is possible to choose the methods that twists tight a strip laminated sheet (4) that is folded at the center of cross direction, or twists without folding.

The desirable numbers of twist or wind are 55~70 per 1 m. With these numbers of twist or wind, the inventor has determined that the strength of braiding yarn (2) becomes extremely high. Further, it is preferable that the strip laminated sheet (4) is twist processed so that the bundle of opened carbon multifilament (7) positions on the outside. In this case, as mentioned afterwards, the bundle of opened carbon multifilament (7) can be positioned on the surface of the packing (1). Since the bundle of opened carbon multifilament (7) that is separated from the bundle of carbon fiber that is made from carbon fiber multifilament and such surpasses lubricating ability, abrasion resistance, corrosion resistance, mechanical strength and sealing ability, by using this bundle of sprit fibber (7) as a material, it is possible to gain the packing (1) with standing lubricating ability, abrasion resistance, corrosion resistance, mechanical strength and sealing ability.

Further more, since this braiding yarn (2) surpasses flexibility, it is possible to do complex braided processing easily, and even if it is done complex processing, it doesn't cause fracture in a strip laminated sheet (4). Additionally, since a strip laminated sheet (4) that constructs braiding yarn (2) has enough tolerance tensile force, so there is no risk during a braided manufacturing.

Figure 8:
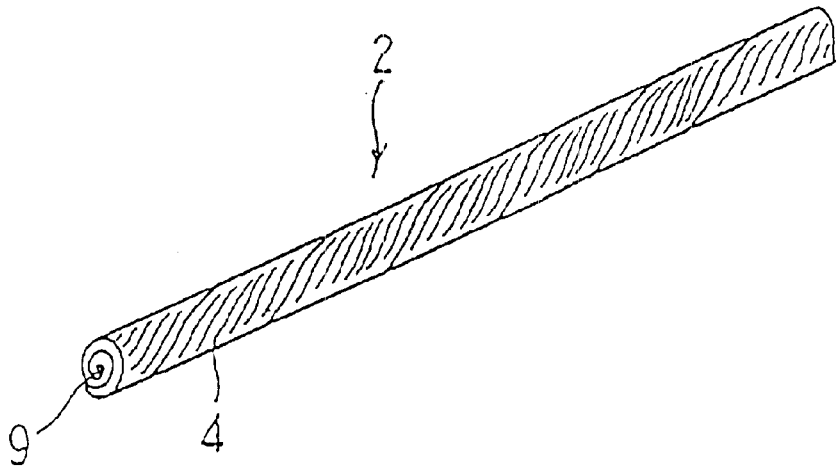
FIG. 8 is a perspective view showing the second example of the first embodiment of the braiding yarn set forth the present invention.
Figure 9:
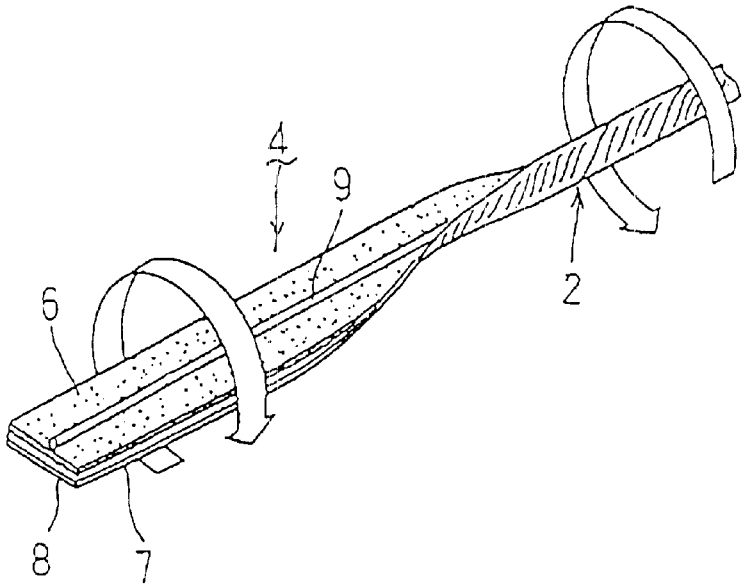
FIG. 9 is a view showing a producing process of the braiding yarn shown in FIG. 8.

Finally, the braiding yarn (2), as shown in FIG. 8 and FIG. 9, can comprise a structure with reinforcing linear member (9) (the second example of the first embodiment of the braiding yarn). Concretely speaking, it can compose a structure that put reinforcing linear member (9) as a core, and the strip of laminated sheet (4) is winded around the reinforcing linear member (9), or it can compose a twisted structure that makes the strip of laminated sheet (4) as shown in FIG. 9 so that the strip laminated sheet (4) covers the reinforcing linear member (9). In such case, allowable tensile force of the braiding yarn (2) can be improved than a braiding yarn that is constructed only a strip laminated sheet (4).

The material of the reinforcing linear member (9) is not particularly restricted, and any materials can suitably be used if it has necessary strength as a material for packing, for example, metals such as Monel metal, inconel, stainless steel, copper and aluminum, glass fiber, ceramic fiber, synthetic resin fiber such as aramid resin, polytetrafluoroethylene resin (PTFE), nylon resin, acrylic resin and phenol resin, synthetic resin fibers soaked with lubricating oil, carbide of synthetic resin fibers and asbestos.

It is preferable for the reinforcing linear member (9) to have its diameter below 3·. If the diameter is such length, a twist processing of the strip laminated sheet (4) can easily be carried out.

Additionally, only one piece of this reinforcing linear member (9) may be used, and plural pieces thereof may also be used as describe after. If one piece is used, the reinforcing linear member (9), for example, may be used as it is, without braiding, or it may be used as a cord body that has been braided. Further, if plural pieces are used, the reinforcing linear member (9) may be used by bundling together, or as a cord body that has been bundled and braded.

The sectional form of each linear member rod that composes reinforcing linear member (9) is not particularly restricted, for example, it is possible to use many configurations such as orbicular section, rectangle section and elliptical section and such.

A cord body (3) in forms of knitted cord, braided cord, plaited cord and such can be constructed by braiding with such braiding yarn (2) which is gained. Concretely speaking, braiding with one or plural pieces of braiding yarn (2), a cord body (3) in forms of knitted cord such as a roundly knitted cord and a squarely braided cord can be constructed. In addition to these, a cord body (3) in a shape of double braided cord or fasten cord can be constructed. In case of braiding cords, a spontaneous braiding method wherein four, eight, sixteen, eighteen, twenty-four or thirty-two of the braiding yarn has been used.

The cord body (3) has a structure that a bundle of opened carbon multifilament (7) or an expansive graphite sheet (6) is positioned outside. Since a packing (1) is constructed by a pressure forming of this cord body (3), so a bundle of opened carbon multifilament (7) or an expansive graphite sheet (6) can be displaced on the surface of the packing (1). It is preferable to have a structure that the bundle of opened carbon multifilament (7) is positioned outside as it mentioned such.

In case of using PVA as an adhesive layer (8), the PVA layer is positioned in the inside of the cord body (3), but it can be removed after forming the cord body (3). Although, the PVA layer surpasses as a reinforcing material, as it has a characteristic that may easily cause stress relaxation, by removing of this layer, it can prevent stress relaxation. And thus, it can make no stress relaxation to the packing (1). Additionally, when is a reinforcing material necessary, is when the greatest tensile force acts to the expansive graphite sheet (6), so, when constructing the braiding yarn (2) and when constructing the cord body (3), this there will be no problem even if the PVA layer is removed after constructing the cord body (3).

When removing the cord body (3) soaking of liquid resin to the cord body (3) is preferable. This is for a portion at where the PVA layer existed to form a space when removing the PVA layer. If the cord body (3) is soaked in the liquid resin, the space can be filled with the liquid resin. By filling the space with the liquid resin, passing through of fluid from the inside of the cord body (3) can be prevented when using the packing (1) in side of the stuffing box. Therefore, sealing ability of the packing (1) can be raised.

As the liquid resin for soaking the cord body (3), the examples are fluorocarbon resin such as polytetrafluoroethylene resin (PTFE), silicone resin, water-soluble phenolic resin, and emulsion resin including inorganic pulverized powder such as glass, alumina, silica gel, graphite and titanium. Also, for the cord body (3), more than one or two liquid resin selected from a group comprising these liquid resins can be soaked into. As a soaking method, for example, it is found such as natural soaking (dip brazing soaking), heat soaking and vacuum soaking.

A packing (1) can be gained by a pressure forming of this cord body (3). The packing (1), for example, as mentioned in FIG. 5, is formed in a ring shape. The packing (1) that is formed a ring shape is packed into a stuffing box and used suitably as a packing for sealing of fluid apparatus. The packing (1) as mentioned previously, has a structure wherein the bundle of opened carbon. multifilament (7) or expansive graphite sheet (6) position on the surface thereof. Therefore, the packing (1) can be made to have outstanding lubricating ability, sealing ability, abrasion resistance mechanical strength and corrosion resistance. It can be made to the packing (1) that has more lubricating ability, sealing ability, abrasion resistance mechanical strength, and corrosion resistance by comprising the structure of appearing the bundle of opened carbon multifilament (7) on the surface of packing (1).

When compared to the one with PVA layer removed, the packing (1) with the PVA layer can be produced without the removing operation thus it is not only possible to make the production easy, but also to lower the production costs.

On the other hand, the packing wherein the PVA layer is removed has no ability of stress relaxation due to the PVA layer. Therefore, the sealing ability thereof can be raised more than that with PVA layer. Also, the packing (1) comprising the cord body (3) which is soaked with liquid resin after removing the PVA layer is in a condition where the inside of the cord body (3) with no stress relaxation ability is filled fully, can raise its sealing ability more.

A producing method of the packing (1) set forth in this investment will be explained in the next place.

This producing method of the packing (1), as mentioned previously, is comprised of; a laminated sheet (5) that is constructed by laminating and unifying the bundle of opened carbon multifilament (7) through the adhesive layer (8) on the surface of expansive graphite sheet (6) (1st Process); the strip laminated sheet (4) is constructed by cutting this laminated sheet (5) along the longitudinal direction of the bundle of the opened carbon multifilament (7) (2nd Process); the braiding yarn (2) is constructed by winding or twisting this strip laminated sheet (4) (3rd Process); the cord body (3) is constructed by braiding with this braiding yarn (2) (4th Process); and the cord body (3) is pressure formed at the end (5th Process).

The details of each process will be explained successively hereinafter.

The 1st process is explained. When laminating the bundle of opened carbon multifilament (7) on one surface of the expansive graphite sheet (6), the various adhesive layer (8) made from such as PVA and chloroprene rubber is intervened between the bundle of opened carbon multifilament (7) and the expansive graphite sheet (6), and it can be laminated and unified strengthen by pressuring to the thick direction of this three layer structure from both side or one side, or it also can be laminated and unified strengthen by pressuring with heating. It is preferable to use the expansive graphite sheet (6) with unevenness in the crystal level on the surface thereof. From doing this, the expansive graphite sheet (6) can cause an anchor effect to the adhesive layer (8) for laminating the bundle of opened carbon multifilament (7). By using such expansive graphite sheet (6), it becomes possible to satisfactorily laminate with the bundle of opened carbon multifilament (7).

The adhesive layer (8) can be formed, for example, by applying or spraying. When the adhesive layer (8) to be a nonwoven fabric-like PVA layer, the PVA layer is formed by spraying PVA water solution under hydraulic pressure on the one side of the expansive graphite sheet (6) or the bundle of opened carbon multifilament (7). By spraying PVA water solution with hydraulic pressure, the PVA water solution cakes like fiber on the expansive graphite sheet (6) or the bundle of opened carbon multifilament (7). At this time, each fiber cakes in a state of stretching toward irregular directions and reciprocally intertwining. Then, by carrying out of the spraying work for a certain period time, fiber which is in a state of stretching toward irregular directions and reciprocally intertwining will accumulate and cake, and thus, the nonwoven fabric-like PVA layer is formed.

The 2nd process is explained. The strip laminated sheet (4) is constructed by cutting the laminated sheet (5) along the longitudinal direction of the bundle of the opened carbon multifilament (7). At this time, when considering the following twist or wind processing, it is preferable to cut the laminated sheet (5) with its width below 25 mm. Since the expansive graphite sheet (6) has a structure being reinforced with the PVA layer. and with the bundle of opened carbon multifilament (7) as mentioned previously, even with its width below 25 mm or even below 10 mm, it can bear the tensile force occurs at the time of a twist or wind processing. Furthermore, since the strip laminated sheet (4) has its structure being reinforced sufficiently, it can be formed comparatively thin, and even with its width in the range mentioned above, it surpasses in flexibility and facilitates the twist and wind processing.

The 3rd process is explained. The braiding yarn (2) is constructed by twisting or winding of the strip laminated sheet (4). As mentioned above, the strip laminated sheet (4) can withstanding the tensile force occurs at the time of twist or wind process, even with its width below 10 mm. Also, since the strip laminated sheet (4) with its width below 10 mm surpasses in flexibility, it can easily be twist and wind processed. Since the braiding yarn (2) that is gained in such way surpassing in flexibility, a complex braiding can be done.

Additionally, it is possible to construct a braiding yarn (2) that is reinforced with the reinforcing linear member (9) as mentioned above. In such case, the strip laminated sheet (4) may be twist and wind processed so that the strip laminated sheet (4) covers the reinforcing linear member (9). Then, the allowable tensile force of the braiding yarn (2) can be raised.

The 4th process is explained. The cord body (3) is constructed by using the various braiding methods as mentioned above with this braiding yarn (2). Since the braiding yarn (2) surpasses in flexibility, a complex braiding can be done. Therefore, the cord body (3) that is gained from the braiding yarn (2) surpasses in flexibility. Additionally, as mentioned above, the PVA layer as an adhesive layer (8) can be removed from the cord body (3) after constructing the cord body (3). As for a method for removing PVA layer, a water bathing method of cord body (3) can be mentioned. Since the PVA resin is water soluble synthetic resin, it can be easily and quickly dissolved and removed by a water bathing. By removing the PVA layer in this way, the stress relaxation of the PVA layer can be deprived from the cord body (3).

When removing the PVA layer, soaking of the cord body (3) with liquid resin for filling the space formed by the removing is preferable. From doing this, the space is filled. Therefore, it becomes possible to gain a gland packing made from expansive graphite (1) with less stress relaxation and high sealing ability.

The 5th process is explained. A packing (1) is constructed by a pressure forming of the cord body (3) in a mold. The shape of the packing (1) is not particularly restricted, but it is not normally constructed in a ring-shape.

This is the end of a production process of the packing (1).

Figure 10:
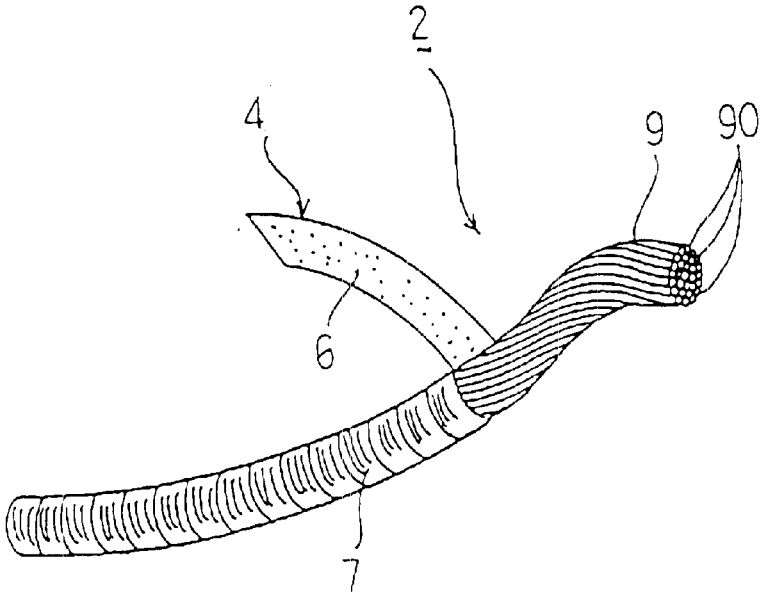
FIG. 10 is a perspective view showing the third example of the first embodiment of the braiding yarn set forth the present invention.

The FIG. 10 is a view showing the third example of the first embodiment of braiding yarn of the present invention. The example shown in FIG. 1 and FIG. 2 are applicable mainly when a diameter of the reinforcing linear member (9) is shorter than the width of the strip laminated sheet (4), but when a length of a diameter of the reinforcing linear member (9) is same or wider than the width of the strip laminated sheet (4), it is preferable to construct the braiding yarn (2) by winding the strip laminate sheet (4) to the round of the reinforcing linear member (9) shown in FIG. 9.

Figure 11:
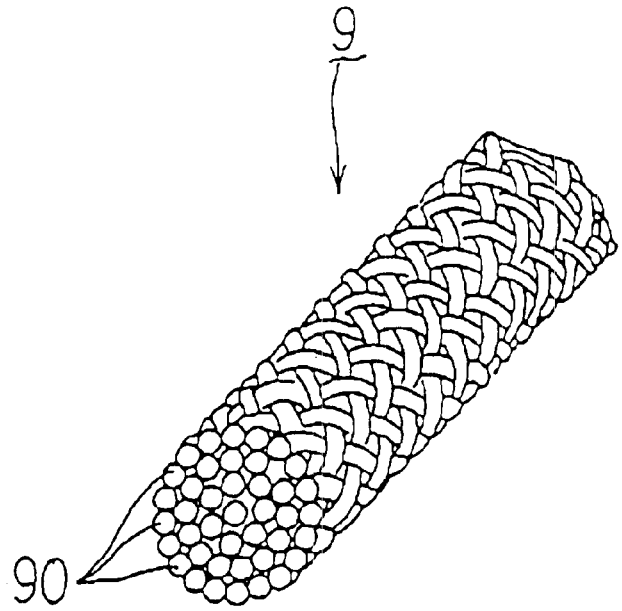
FIG. 11 is a perspective view showing an example of reinforcing linear member.
Figure 12:
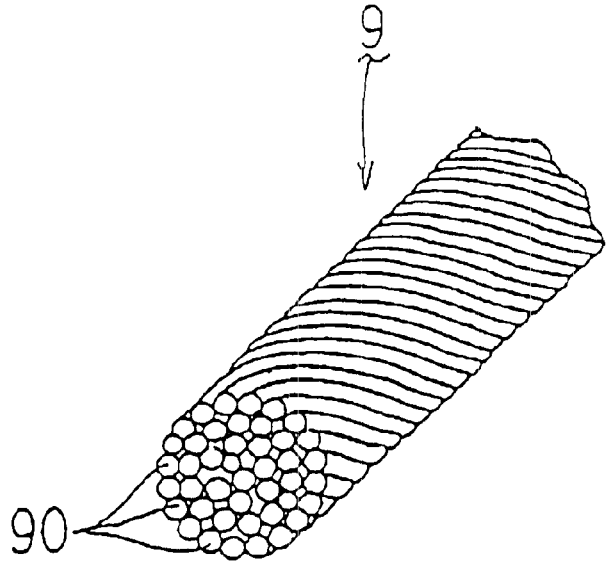
FIG. 12 is a perspective view showing an example of a reinforcing linear member.
Figure 13:
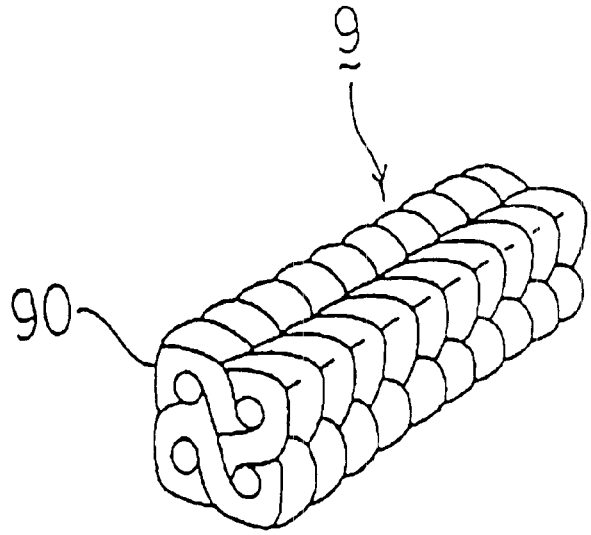
FIG. 13 is a perspective view showing an example of a reinforcing linear member.
Figure 14:
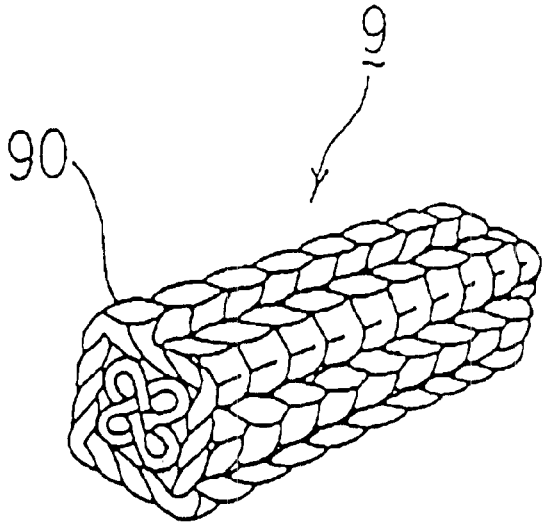
FIG. 14 is a perspective view showing an example of a reinforcing linear member.
Figure 15:
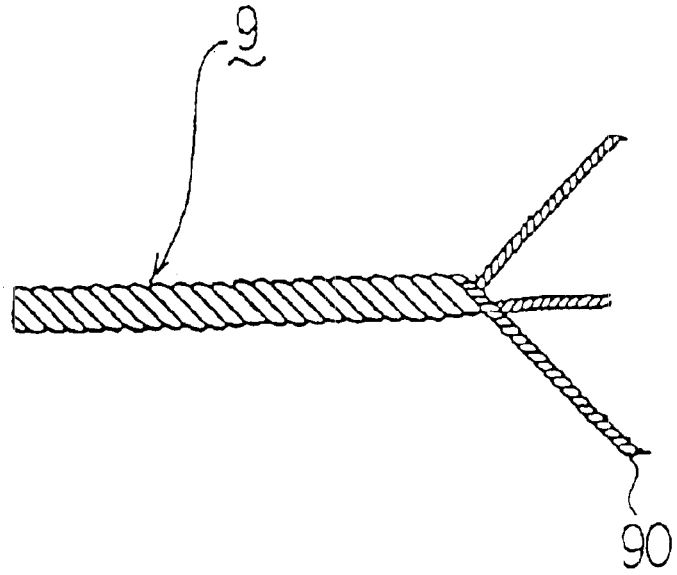
FIG. 15 is a perspective view showing an example of a reinforcing linear member.

The example shown in FIG. 10, the reinforcing linear member is constructed by binding the plural solid linear member (90). Although, the configuration of binding is not particularly restricted, for example, it can be constructed by the condition of round braid yarn shown in FIG. 11 and FIG. 12, square braid yarn shown in FIG. 13 and FIG. 14, cord and square cord. Additionally, in a case of braiding cords, as mentioned above, a spontaneous braiding method wherein four, eight or sixteen of the braiding yarn has been used. Also, it is applicable to use the plural solid linear member (90) that is bound and twisted shown in FIG. 15.

In this example, the strip laminate sheet (4) can be constructed by laminating and unifying the bundle of opened carbon multifilament (7) that is intervened adhesive layer to the expansive graphite sheet (6), and cut this bundle of opened carbon multifilament (7) along the direction of longitudinal.

Figure 16:
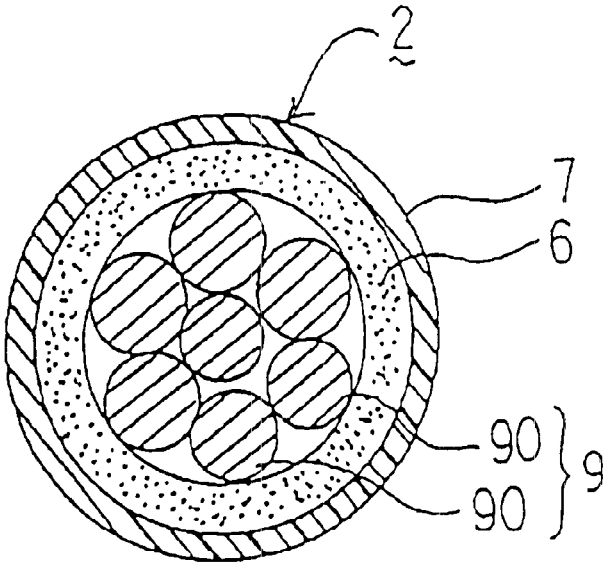
FIG. 16 is a sectional view showing braiding yarn shown in FIG. 10.

Since the braiding yarn (2) shown in FIG. 10 is used quantity of the reinforcing linear member (9) per unit area as a sectional view shown in FIG. 16, the mechanical strength has been big due to the structure of the surface of the braiding yarn (2) is covered by the strip laminate sheet (4) that is comprised by the expansive graphite sheet (6) and the bundle of opened carbon multifilament (7), the sealing characteristic that is stored by the expansive graphite and the bundle of opened carbon multifilament (7) is appeared sufficiently, besides more, the braiding yarn (2) does not damage the surface of another metal. Therefore, since the very high mechanical strength is appeared, for example, the braiding yarn (2) is used as replacements of bush and distance pieces.

Figure 7:
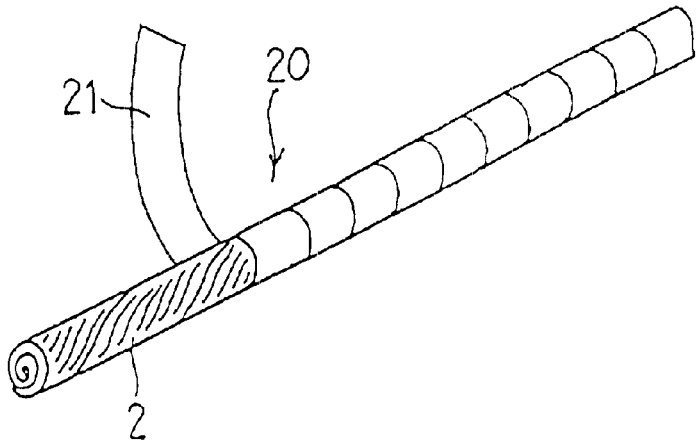
FIG. 7 is a perspective view showing the forth example of the first embodiment of the braiding yarn set forth the present invention.

The FIG. 7 is a view showing forth example of first embodiment of a braiding yarn of the present invention.

In fourth example, the braiding yarn (20) is constructed by covering the peripheral side of the braiding yarn (2) by a sprit foil made from aluminum and so on shown in the first, second and third example of the first embodiment of the braiding yarn (2), for example, shown in FIGS. 1, 8, 9, and 10. In short, the braiding yarn (2) that is concerned with first and second example is considered to be a partially fabricated item (designated as a filamentous body (2) ) of the braiding yarn (20) that is concerned with the forth example. Then the braiding yarn (20) (referred to FIG. 7) is constructed by a filamentous that is constructed by winding or twisting a sprit foil made from a metal among aluminum, aluminum alloy, nickel, nickel alloy, copper and copper alloy, as cover the filamentous body (2) continuously or intermittently.

The braiding yarn (20) shown in FIG. 7, the sprit foil (21) that is made from aluminum and aluminum alloy is positioned at the surface part. Due to these metals such as aluminum surpasses conformability, the packing is constructed by the braiding yarn (20), when this packing is used in stuffing box, and these metals tight adhere to the surface of stuffing box. Therefore, it can be improved the sealing ability more. Also, in case of the covering component is not set up on the surface of expansive graphite and the bundle of the carbon fiber, when the expansive graphite and the bundle of the carbon fiber are used in stuffing box and so on, there is a possibility of sticking out from a gap between a shaft and a bearing by fastening pressure. However, as for this example, by covering the outside of expansive graphite and the bundle of carbon fiber by the strip foil (21), it can be prevented to stick out the expansive graphite and the bundle of carbon fiber from the gap. Besides, when the expansive graphite and the bundle of carbon fiber is exposed, there is a possibility of constructing an electric pole of local battery between these components and a stuffing box. However, the metals such as aluminum as mentioned above, it is difficult to construct an electric pole of local battery to mainly iron metals, and even if it became an electric pole, it becomes an anode, so there is no possibility of corrosion of machinery such as stuffing box that is constructed by a steel.

Further, a thick of the sprit foil (21) is not particularly restricted, but 0.01~0.05 mm is desirable, 0.02~0.03 mm is more desirable and 0.03 mm is most preferable. To make the thick is below 0.01 mm is difficult with too thin to behind the durability. When a thick is over 0.05 mm, the adhesion with expansive graphite or the bundle of carbon fiber declines with the sealing ability by the expansive graphite or the bundle of the carbon fiber is not exercised sufficiently.

Also, a width of the strip foil is not particularly restricted, for example, an extent of 3 mm is well.

Besides, in case of constructing a braiding yarn (20), it can be used a unit or plural strip foil (21). When the plural strip foil (21) is used, it can be used with lapping the strip foil (21).

The following is to explain the second embodiment of the present invention with a reference made to the drawings.

Figure 17:
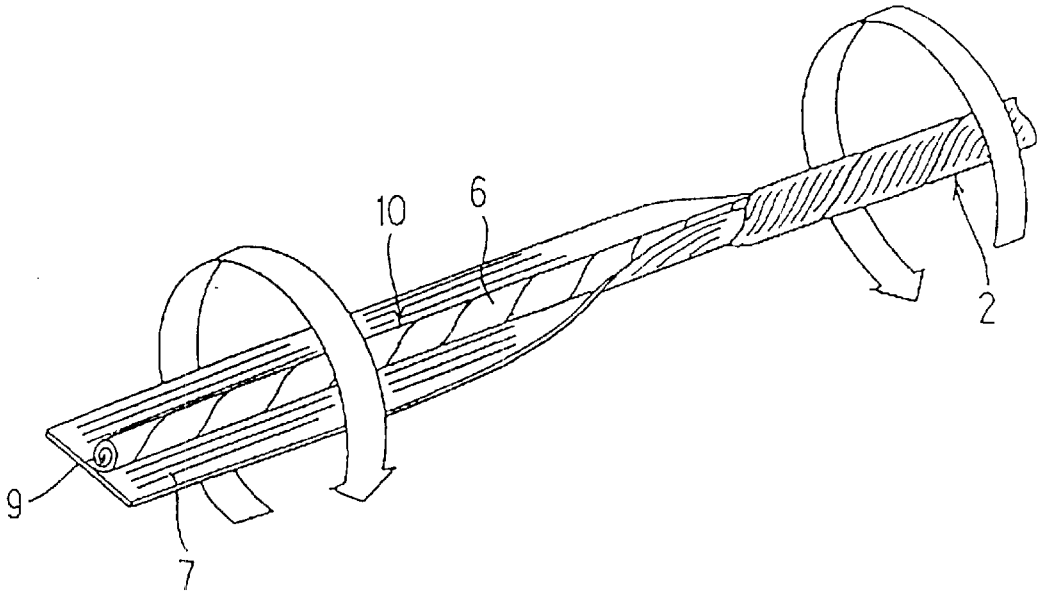
FIG. 17 is a perspective view showing a producing process of the second embodiment set forth the present invention.

FIG. 17 is a view showing a production process of the braiding yarn of the second embodiment. Additionally, a cord body is explained with applying to FIG. 4 showing the first embodiment.

The braiding yarn (2) of the second embodiment is filamentous wherein: after roll operation of a strip expansive graphite sheet (6) together with reinforcing linear member (9); a filamentous body (10) is constructed by winding or twisting such rolling materials; a filamentous body is constructed by winding or twisting a strip bundle of opened carbon multifilament (7) so that covers the filamentous body as a shaft. FIG. 17 is shown an appearance of twisting the bundle of opened carbon multifilament (7).

The thickness of the expansive graphite sheet that is used this second embodiment is preferable from about 0.05~0.5 mm. The reason is that when the thickness is below 0.05 mm, there is a possibility of break the expansive graphite sheet (6) itself after roll operation because of too thin, on the other hand, when the thickness is more than 0.5 mm, there is a possibility of difficulty of twisting after roll operation because of too thick.

This expansive graphite sheet (6) is cut into strips with a slitter and such, and the strip expansive graphite sheet (6) is produced in this way.

It is preferable to have 3~30 mm the width of the strip expansive graphite sheet (6), and with such width, it can be easily and certainly rolled together with the reinforcing linear member (9).

This strip expansive graphite sheet (6) is pressure rolled by a rolling roller material wherein the reinforcing linear member (9) is embedded along the orientation of shaft length within the expansive graphite sheet (6) is formed. After that, this rolled material becomes a filamentous body (10) by winding or twisting processing (referred to FIG. 17). Additionally, when gaining the filamentous body (10), either method of a single rolling which is to roll the rolled material for once or a double rolling which is to roll twice can be used.

The shape of section of reinforcing linear member (9) is not particularly restricted. Also, materials of the reinforcing linear member (9) are not particularly restricted, for example, the materials as same as the reinforcing linear member (9) that is mentioned above can be applicable.

The diameter of the reinforcing linear member (9) is not particularly restricted, but about 0.08~0.20 mm of diameter is desirable, and about 0.12~0.15 mm of diameter is more desirable. If the diameter is below 0.20 mm, it can be certainly be embedded in the strip expansive graphite sheet (6), and said twisting processing of the rolled material can easily be done.

The reasons for using the reinforcing linear member (9) in the third embodiment are to produce rolled materials that can fully withstanding a twisting processing and to produce braiding yarn that can fully withstand a braiding process (especially against a mechanical braiding).

In other wards, since a rolled material or braiding yarn in which only expansive graphite is used has low tensile strength, they are fragile and are easy tone and shrunk. Especially, such braiding yarn cannot be used as braiding yarn for mechanical braiding. However, by constructing a rolled material wherein the reinforcing linear member (9) is embedded within the expansive graphite sheet (6), great strength of the reinforcing linear member (9) is given to the expansive graphite sheet (6), and thus, a rolled material and braiding yarn which are suitable for twist processing and mechanical braiding.

The braiding yarn (2) is produced by winding or twisting processing of the strip bundle opened carbon multifilament (7) with this filamentous body (10) being covered (referred to FIG. 17). With said rolled material being filamentous processed as a single yarn, the braiding yarn (2) may be constructed by the strip bundle of opened carbon multifilament (7) being wind or twist around this filamentous body, or the braiding yarn (2) may be constructed by the strip bundle of opened carbon multifilament (7) being winding or twisting with plural of said single yarn being twisted together as twisted yarn.

The strip bundle of opened carbon multifilament (7) is to improve the mechanical strength, lubricating ability and sealing ability of the braiding yarn (2).

Additionally, it is preferred to have the thickness of the strip bundle of opened carbon multifilament (7) being 0.05~0.5 mm, it is more desirable being 0.15~0.2 mm. This is because if the thickness is below 0.05mm, sufficient lubricating ability nor sealing ability cannot be gained, and conversely, if the thickness is over 0.5 mm, sufficient flexibility cannot be gained.

The braiding yarn (2) gained in such way will not easily tear nor shrink, and is braided with a braiding machine, so that the cord body (3) as exemplified in FIG. 4 will be gained.

By a pressure forming of this cord body (3), a ring-shape packing (1) is gained (referred to FIG. 5).

Since this gland packing made from expansive graphite (6) is constructed from the braiding yarn (2) that not only has a big allowable tensile force but also surpasses in flexibility, it is possible to make the packing (1) to be easy to be produced and to surpasses in sealing ability. Also, having the strip bundle of opened carbon multifilament (7) positioning on the outside the gland packing made from expansive graphite (1) can be made to surpasses in lubricating ability, sealing ability, abrasion resistance and corrosion resistance in the same way as the first embodiment.

Further, in this second embodiment, it is possible to use strip foil as mentioned above (not being illustrate) instead of the strip bundle of opened carbon multifilament (7). As materials for this strip foil, for example, aluminum, aluminum alloy, nickel, nickel alloy, copper and copper alloy can be used. When a strip foil is used, it can be used a piece of strip foil or plural strip foils, when a strip foil is used with plural, these strip foils can be used with a condition of lapping reciprocally.

The following is to explain the third embodiment of braiding yarn of the present invention with a reference made to drawings.

Figure 18:
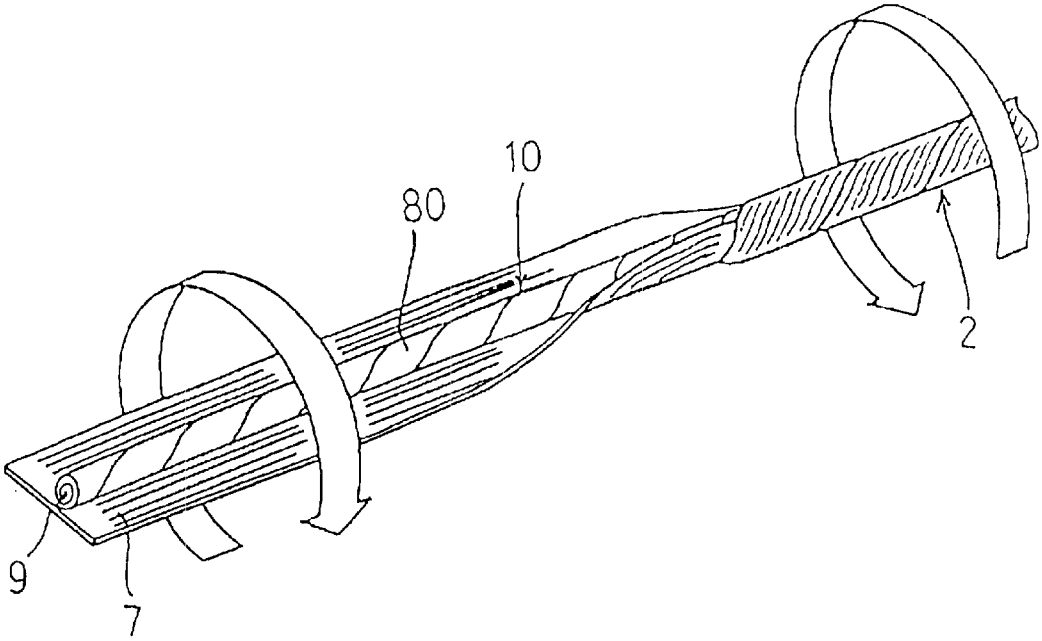
FIG. 18 is a perspective view showing a producing process of the third embodiment set forth from the present invention.
Figure 19:
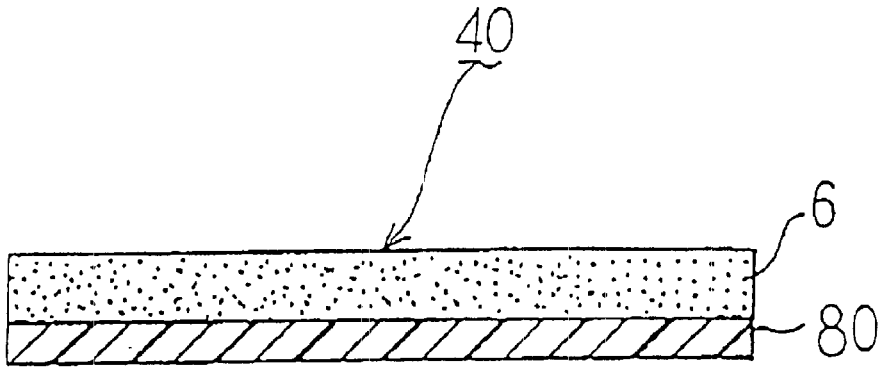
FIG. 19 is a sectional view showing a strip laminated sheet that is used in case of constructing braiding yarn shown in FIG. 18.

FIG. 18 is a view showing a producing process of braiding yarn of the third embodiment. FIG. 19 is a sectional view showing a strip laminate sheet that is used when the braiding yarn shown FIG. 18 is constructed.

The structure of the braiding yarn (2) of the third embodiment is explained hereinafter.

The braiding yarn is constructed by winding or twisting of a strip bundle of opened carbon multifilament (7) wherein a filamntose body (10) that is constructed by winding or twisting the strip laminated sheet (40) comprising the PVA layer (80) set at least on one side of the expansive graphite sheet (6) is covered as an core. Further, FIG. 18 is explained a case wherein the strip bundle of opened carbon multifilament (7) is produced by a twist process.

The structure such as material and thickness of expansive graphite sheet can be in same way the first embodiment as mentioned above. Also, such as the thickness of the PVA layer (80) and locating method can be in same way of PVA layer as an adhesive as mentioned above.

The laminated sheet that is constructed from the expansive graphite sheet (6) and the PVA layer (80) is cut into strips and be a strip laminated sheet (40). Additionally, its width is not particularly restricted, but for example, it is 5~30 mm, it is preferable 5~25 mm. In this third embodiment, since the expansive graphite sheet is reinforced by PVA layer (80), the thickness of the strip laminated sheet can be relatively thin. Therefore, even if the width is about 30 mm, it can be gained the strip laminated sheet that has easily processing, resistance to tension in processing and sufficient flexibility.

The braiding yarn (2) is constructed by winding or twisting the strip bundle of opened carbon multifilament (7) wherein a filamentous body (10) that is constructed by the strip laminated sheet like this with winding or twisting in same way of the second embodiment is covered as a core. Further, when the filamentous body (10) is constructed, it is possible to construct the filamentous body (10) by winding or twisting a strip laminated sheet so as to cover the reinforcing linear member (9). Also, either method of a single rolling that is to roll the strip bundle of opened carbon multifilament (7) iby winding or twisting for once or a double rolling that is to roll the strip bundle of opened carbon multifilament (7) again by winding or twisting can be used.

Then, the cord body (3) (referred to FIG. 4) can be gained by braiding this braiding yarn (2). The next, the ring-shape grand packing (1) can be gained by being pressure formed of this cord body (3) (for example referred to FIG. 5).

Further, in this third embodiment as same as the first embodiment, the gland packing (1) can be gained by pressure formed of the cord body (3) wherein after the cord body (3) is constructed, the cord body (3) is elution removed PVA layer (80) and dried. Also, it can be gained this cord body (3) wherein: a cord body (3) is dried after the PVA is elution removed; it is soaked liquid resin as same as the first embodiment; it is pressure formed.

Each embodiment of this invention has been explained in the above, however, the structures of strip laminated sheet (4), braiding yarn (2), cord body (3) and packing (1) of present invention is not restricted as embodiment that is mentioned above. For example, in the first and third embodiment, the laminating of PVA layer can be done by spraying of PVA water solution as mentioned above, the laminating method of present invention is not restricted in this method. For example, it is possible to form a nonwoven fabric-like PVA sheet (not being illustrated) by spraying the PVA water solution on a surface of a heated roller and to laminate this PVA sheet on the surface of expansive graphite sheet (6) by heat fusion. In such case, the temperature used for the heat fusion is preferably 185~195·. If the temperature is below 185·, there is a risk of having the fusion being insufficient, and on the other hand, if it is over 195·, there is a risk of the nonwoven fabric-like organization being broken. Further, the PVA layer does not have to be like a nonwoven fabric, and it may be in forms of a film or a mesh. If it is a case of PVA layer being in a film form, the previously formed PVA resin in the film form may be laminated on the expansive graphite sheet (6) by heat fusion. If it is a case of PVA layer being in a mesh form, the previously formed PVA resin in the mesh form may be laminated on the expansive graphite sheet (6) or the bundle of opened carbon multifilament (7).

Embodiment

The following is to explain the embodiments of the present invention. However, the present invention is not particularly restricted to these embodiments.

(Tensile Test of Laminated Sheet) (Embodiment)

Figure 20:
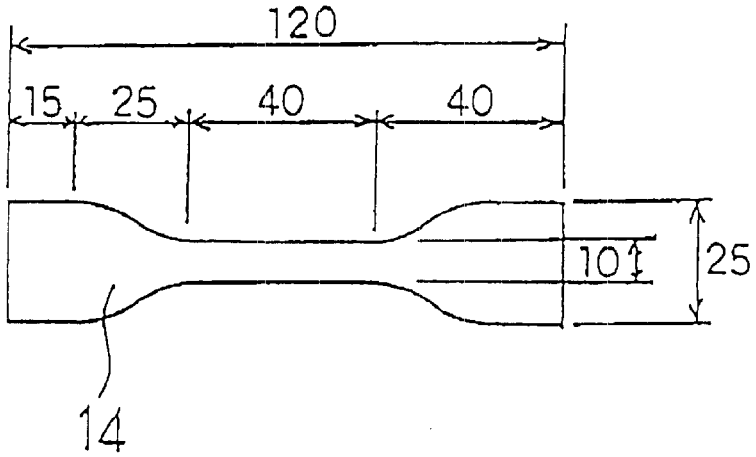
FIG. 20 is a view showing the size of the laminated sheet that is served in tensile test.

A laminated sheet was constructed by laminating a bundle of opened carbon multifilament of its thickness 0.2 mm through PVA adhesive layer on a surface of expansive graphite sheet of its thickness 0.2 mm and density 1.1 g/cm$^3$, then these are laminated and unified by a heat fusion of a PVA adhesive layer. Then, a test strip (14) was constructed by cutting this laminated sheet into the size shown in FIG. 20. The unit of length used in FIG. 20 is mm.

(Comparative Test)

A laminated sheet was constructed by laminating a cotton woven fabric sheet of its thickness 0.15 mm using a heat fusi film on both surfaces of expansive graphite sheet of its thickness 0.2 mm and density is 1.0 g/cm$^3$. Then, a test strip (14) was constructed by cutting this laminated sheet into the size shown in FIG. 20.

Four of each test strips (14) set forth in the embodiment and comparative test were prepared, and for these test strips, tensile force tests based on JIS K 6301–1975 (property testing method of vulcanized rubber) at a temperature 22·. As a tensile tester, a resin tensile tester produced by Toyoseiki Co. Ltd. is used.

The test result of the embodiment is shown in Table 1, and the test result of the comparative test is shown in Table

TABLE 1

| | Tensile Strength (N/mm$^2$) | |
|---|---|---|
| Embodiment No | Measured Value | Average Value |
| 1 | 65.2 | 64.73 |
| 2 | 64.6 | |
| 3 | 65.4 | |
| 4 | 63.7 | |

TABLE 2

| | Tensile Strength (N/mm$^2$) | |
|---|---|---|
| Comparative No | Measured Value | Average Value |
| 1 | 2.8 | 2.8 |
| 2 | 2.7 | |
| 3 | 2.7 | |
| 4 | 2.9 | |

From the above results, it is clear that the tensile strength of the embodiments that the PVA layer and the bundle of opened carbon multifilament is used as reinforcing materials are obviously greater than are those of the comparative Test that cotton woven fabric is used as a reinforcing material.

(Torque Test of Grand Packing made from Expansive Graphite)

A laminated sheet was constructed by laminating a bundle of opened carbon multifilament of its thickness is 0.2 mm through PVA adhesive layer on a surface of expansive graphite of its thickness is 0.2 mm and density is 1.0 g/cm$^3$, and these are laminated and unified by using a heat fusion of PVA adhesive layer. Then, a strip laminated sheet was constructed by cutting this laminated sheet into width 10 mm. Then, braiding yarn was formed by a twist processing of this laminated sheet, and a cord body is constructed by braiding this braiding yarn, and finally, this is pressure formed in order to construct a ring-shape gland packing made from expansive graphite. Further, it is constructed that the bundle of opened carbon multifilament is positioned outside of gland packing. Furthermore, the size of the gland packing made from expansive graphite was to be ·185·218ƶ6 (·1:inside diameter, ·2:outside diameter, t:thickness (The unit for all of these is mm.)).

(Comparative Test)

A laminated sheet was constructed by laminating a cotton woven fabric of its thickness is 15 mm using a heat fusion film on a surface of expansive graphite sheet of its thickness is 0.2 mm and density is 1.0 g/cm$^3$. Then, a strip laminated sheet was constructed by cutting this laminated sheet into width 10 mm. Then, braiding yarn was formed by a twist processing of this laminated sheet, and a cord body is constructed by braiding this braiding yarn, and finally, this is pressure formed in order to construct a ring shape gland packing made from expansive graphite.

Furthermore, the size of the gland packing made from expansive graphite was to be ·18ラ·218ラ6 (·1:inside diameter, ·2:outside diameter, t:thickness (The unit for all of these is mm.)).

Figure 21:
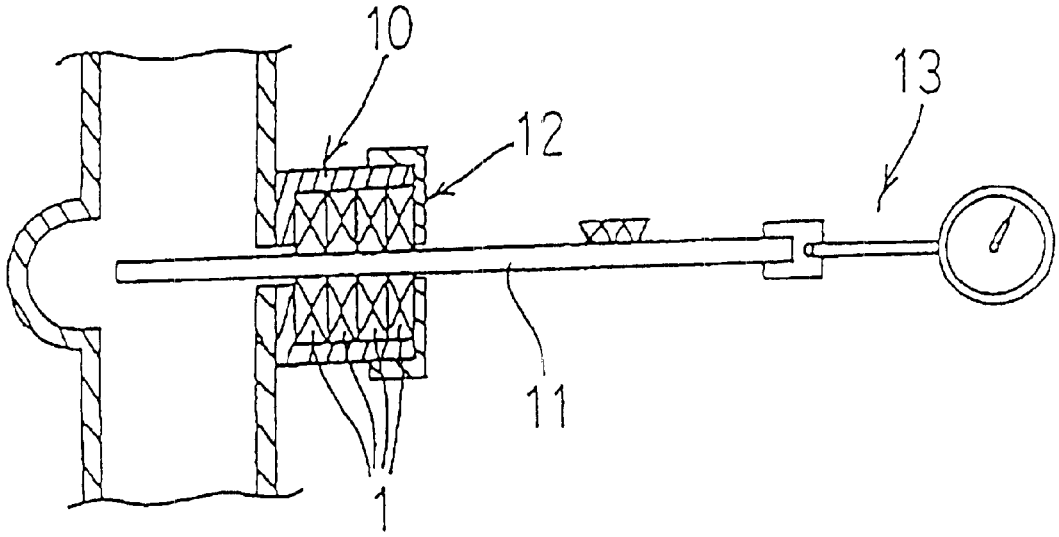
FIG. 21 is a view showing the situation of torque test.

FIG. 21 is a view showing a situation of the embodiment of the torque test. As carrying out the torque test, four of gland packing made from expansive graphite (1) of the present invention was prepared, and these four gland packing made from expansive graphite (1) were set and displaced in a stuffing box (10) of fluid apparatus indoors at temperature 22·. Then a spindle (11) made from SUS430 with shaft·8 (the unit is mm) was inserted into shaft inserting bore of the gland packing made from expansive graphite (1). Then a locknut (12) was locked with locking pressure 200 k g/cm$^2$, so that each gland packing made from expansive graphite (1) was pressure welded to the inside wall surface of the spindle (11) and a stuffing box (10). Then, the spindle (11) was pulled with a spring balance (13), and the tensile force (which is equal to the maximum frictional force between the spindle and the packing) occurred when the spindle (11) had started to move was measured. The same test was carried out for the gland packing made from the expansive graphite sheet set forth in the comparative test. The test result of the embodiment is shown in Table 3, and the test result of the comparative test is shown in Table 4.

TABLE 3

| | Tensile Strength (kg) | |
|---|---|---|
| Embodiment No | Measured Value | Average Value |
| 1 | 1.68 | 1.635 |
| 2 | 1.72 | |
| 3 | 1.58 | |
| 4 | 1.56 | |

TABLE 4

| | Tensile Strength (kg) | |
|---|---|---|
| Comparative No | Measured Value | Average Value |
| 1 | 1.8 | 1.975 |
| 2 | 1.9 | |
| 3 | 2.0 | |
| 4 | 2.2 | |

From the above result, it is clear that the tensile force of the embodiment wherein the PVA layer and the bundle of opened carbon multifilament are used as reinforcing meterials are less than those of the comparative test wherein the cotton woven fabric is used as a reinforcing material. This indicates that the lubricating ability of the gland packing set forth in the embodiment is good. Therefore, when turning a spindle inserted into a packing, it is found that using of the gland packing (1) set forth embodiment can turn a spindle with low torque.

The present invention as set forth [in claim 1 is] includes braiding yarn used in a gland packing made from expansive graphite that is gained by a pressure forming of a cord body constructed by braiding with the braiding yarn wherein: a bundle of opened carbon multifilament is laminated and unified through an adhesive layer on a surface of expansive graphite sheet; this adhesive layer is used as a reinforcing material of the strip laminated sheet consisting of the bundle of opened carbon multifilament, adhesive layer, and the expansive graphite sheet; the strip laminated sheet is winded and twisted to be filamentous as the bundle of opened carbon multifilament is positioned outside of the braiding yarn, thus it has the following effect.

That is, since this braiding yarn can be constructed from the sprit laminated sheet that surpasses in flexibility with the strip width is below 30 mm, the braiding yarn can also be distinguished in flexibility. Therefore, a complicated braiding processing can easily be carried out. Also, the allowable tensile force of the strip laminated sheet for constructing this braiding yarn is big, thus there is no risk of tearing at the time of a wind processing, a twist processing and a braiding processing. Further, in case of this braiding yarn is processed as the bundle of carbon fabric is positioned outside, at the time of a packing is constructed, the bundle of carbon fiber can be positioned on a surface of packing. In this case, it is possible to be gained the packing that greatly surpasses lubricating ability, sealing ability, abrasion ability and corrosion ability.

The present invention [as set forth in claim 2 is] includes a braiding yarn [set forth in claim 1] with feature of the strip laminated sheet as mentioned above to be filamentous by wind or twist processing, thus it has the following effects.

That is, since this braiding yarn is stored a reinforcing linear member, it can raise even more the strength to a wind processing, a twist processing and a braiding processing.

The present invention [as set forth in claim 4 is] also includes braiding yarn used in a gland packing made from expansive graphite that is gained by a pressure forming of a cord body constructed by braiding with braiding yarn wherein: a polyvinyl alcohol layer is located at least on one side of expansive graphite sheet, and a filamentous body is constructed by winding or twisting a strip laminated sheet with this polyvinyl alcohol layer as a reinforcing material, and making a bundle of carbon fiber filamentous by winding or twisting so that this filamentous body is covered as an core thus, it has the following effect.

That is, since this braiding yarn can be constructed from the strip laminated sheet with the strip width 10 mm, the braiding yarn can also be distinguished in flexibility. Therefore, a complicated braiding processing can easily be carried out. Also, the allowable tensile force of the strip laminated sheet for constructing this braiding yarn is big, thus there is no risk of tearing at the time of a wind processing, a twist processing and a braiding processing. Further, in case of this braiding yarn is processed as the bundle of carbon fabric is positioned outside, at the time of a packing is constructed, the bundle of carbon fiber can be positioned on a surface of packing. In this case, it is possible to be gained the packing that greatly surpasses lubricating ability, sealing ability, abrasion ability and corrosion ability.

The present invention [as set forth in claim 6 is] also includes a braiding thread used in a gland packing made from expansive graphite which is gained by a pressure forming of a cord body constructed by braiding with braiding thread wherein: a bundle of strip laminated sheet is to be a filamentose by winding or twisting so that it covers filamentose as a core, and this filamentose is constructed by a rolled material which is gained by rolling an expansive graphite sheet together with a reinforcing wire, thus it has the following effects.

That is, since the braiding thread can be distinguished in flexibility with great allowable tensile force, it is possible to obtain a gland packing made from expansive graphite which surpasses in producing facility and sealing ability. Also, when a bundle of sprit fiber is positioned outside, it is possible to obtain a packing which surpasses lubricating ability, sealing ability, abrasion resistance and corrosion resistance. [According to claim 12 and 22, the] The braiding thread can be distinguished in flexibility with great in allowable tensile force, it is possible to obtain a cord body distinguished in flexibility with no fracture point even if through complicate braiding processing. Also, when a bundle of sprit fiber is positioned outside of cord body, the bundle of sprit fiber can be positioned on a surface of packing. In such case, it is possible to obtain a packing that highly surpasses abrasion resistance and corrosion resistance. Also, since the bundle of sprit fiber surpasses lubricating ability and sealing ability, it is possible to obtain a packing that surpasses lubricating ability and sealing ability.

[According to claim 23 and 27, by] By removing the polyvinyl alcohol layer that easily cause stress relaxation, it is possible to make a cord body that does not cause stress relaxation. Thus, it is possible to make a packing to cause no stress relaxation, and to raise the sealing ability of packing.

[According to claim 28 and 32, space] Space formed from removing the polyvinyl alcohol layer can be filled with the liquid resin. By filling space with the liquid resin, fluid can be prevented from passing inner portion of the cord body when using a packing in a stuffing box, raising the sealing ability even more.

[According to claim 33 and 53, by] By constructing a cord body that surpasses flexibility and has no fracture point, it is possible o make a packing that surpasses sealing ability. Also, when a bundle of sprit carbon fiber is positioned outside the packing, it is possible to make a packing that surpasses abrasion ability and corrosion ability. Also, a bundle of sprit carbon fiber surpasses lubricating ability and sealing ability, it is possible to make a packing that surpasses lubricating ability and sealing ability. Also, constructing from a laminated sheet that has big tensile force and surpasses in flexibility, it is possible to make a packing that surpasses easily processing.

What is claimed is:

1. A braiding yarn for use in a gland packing comprising a strip laminated sheet, said strip laminated sheet having an expansive graphite sheet and a bundle of opened carbon multifilaments which are adhered to the expansive graphite sheet through use of an adhesive layer, wherein said strip laminated sheet is twisted so as to form a first filamentous yarn structure having said open carbon multifilaments positioned on the outer periphery of said first filamentous yarn structured.

2. A braiding yarn as set forth in claim 1, wherein said strip laminated sheet is twisted about a reinforcing linear member.

3. A braiding yarn as set forth in claim 2, wherein said reinforcing linear member is constructed from at least one material selected from the group consisting of aramid resin, polytetrafluoroethylene resin, nylon resin, acrylic resin, hydroxybenzene resin, the carbide of these resins, glass, metal, asbestos, and ceramic.

4. A braiding yarn as set forth in claim 1, wherein said first filamentous yarn structure is at least partially wrapped with a second filamentous yam structure constructed form a strip sheet comprising at least one material selected from the group consisting of aluminum, aluminum alloy, nickel, nickel alloy, copper, and copper alloy.

* * * * *